US011578605B2

(12) United States Patent
Park et al.

(10) Patent No.: US 11,578,605 B2
(45) Date of Patent: Feb. 14, 2023

(54) IMPELLER AND METHOD OF MANUFACTURING THE SAME

(71) Applicant: LG ELECTRONICS INC., Seoul (KR)

(72) Inventors: Hanyoung Park, Seoul (KR); Yoonjei Hwang, Seoul (KR); Junhyuk Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/171,371

(22) Filed: Feb. 9, 2021

(65) Prior Publication Data

US 2021/0254482 A1 Aug. 19, 2021

(30) Foreign Application Priority Data

Feb. 18, 2020 (KR) ..... 10-2020-0019884

(51) Int. Cl.

| | |
|---|---|
| ***F04D 29/30*** | (2006.01) |
| ***F01D 5/30*** | (2006.01) |
| ***F01D 5/02*** | (2006.01) |
| ***F04D 29/28*** | (2006.01) |
| *F04D 29/62* | (2006.01) |

(52) U.S. Cl.

CPC ..... *F01D 5/3007* (2013.01); *F01D 5/02* (2013.01); *F04D 29/281* (2013.01); *F04D 29/30* (2013.01); *F04D 29/624* (2013.01); *F05D 2230/232* (2013.01); *F05D 2230/40* (2013.01)

(58) Field of Classification Search

CPC ..... F04D 29/281; F04D 29/30; F04D 29/624

See application file for complete search history.

(56) References Cited

U.S. PATENT DOCUMENTS 3,225,422 A * 12/1965 Sebok ..... B21D 53/267 29/889.4

6,146,094 A * 11/2000 Obana ..... F04D 29/023 415/200

(Continued)

FOREIGN PATENT DOCUMENTS

| | | |
|---|---|---|
| JP | 2019-124209 | 7/2019 |
| KR | 10-1998-0002892 | 3/1998 |

(Continued)

OTHER PUBLICATIONS

Kong, KR 20180130930 A English Translation, 2018 (Year: 2018).*

(Continued)

*Primary Examiner* — Michael L Sehn

(74) *Attorney, Agent, or Firm* — KED & Associates

(57) ABSTRACT

The present disclosure relates to an impeller and a method of manufacturing the same. The impeller includes: a hub in which a plurality of spiral first slots are formed; a shroud which is positioned opposite the hub, and has a plurality of spiral second slots formed therein; and a plurality of blades which is coupled to the hub and the shroud, and have an upper protrusion formed on one side and a lower protrusion formed on the other side; and wherein the upper protrusion is inserted into and coupled to a second hole formed in the second slot, and the lower protrusion is inserted into and coupled to a first hole formed in the first slot.

18 Claims, 10 Drawing Sheets

(56) References Cited

U.S. PATENT DOCUMENTS

| | | | | |
|---|---|---|---|---|
| 6,276,889 | B1 * | 8/2001 | Dortch | B62D 43/045 224/42.24 |
| 6,368,062 | B1 * | 4/2002 | Yagami | F04D 29/282 416/214 R |
| 2002/0148067 | A1 * | 10/2002 | Streeter | A47L 9/00 15/327.1 |
| 2014/0169971 | A1 * | 6/2014 | Vedula | F04D 29/2227 416/185 |
| 2015/0204352 | A1 | 7/2015 | Shen et al. | |

FOREIGN PATENT DOCUMENTS

| | | |
|---|---|---|
| KR | 10-2017-0046238 | 5/2017 |
| KR | 10-1835338 | 3/2018 |
| KR | 10-2018-0130930 | 12/2018 |

OTHER PUBLICATIONS

MatWeb, Magnesium AM60B-F Material Property Data, Die Cast, 1996-2022 (Year: 1996).*

MatWeb, Alunimum 5052-H19 Foil Material Property Data, Die Cast, 1996-2022 (Year: 1996).*

Korean Office Action dated Apr. 19, 2021 issued in Application No. 10-2020-0019884.

Korean Notice of Allowance dated Oct. 21, 2021 issued in KR Application No. 10-2020-0019884.

* cited by examiner

IMPELLER AND METHOD OF MANUFACTURING THE SAME

CROSS-REFERENCE TO RELATED APPLICATION(S)

This application claims priority under 35 U.S.C. § 119 to Korean Application No. 10-2020-0019884 filed on Feb. 18, 2020, whose entire disclosure is hereby incorporated by reference.

BACKGROUND OF THE INVENTION

1. Field of the Invention

The present disclosure relates to an impeller and a method of manufacturing the same, and more particularly, to an impeller that has a structure in which blades that have protrusions on both sides and are manufactured by a sheet metal process are coupled to grooves formed in a shroud and a hub, thereby increasing structural strength and improving manufacturing quality, and a method of manufacturing the same.

2. Description of the Related Art

In general, a chiller is an apparatus that performs heat exchange between cold water and cooling water by using a refrigerant and has a feature that heat exchange is performed between a refrigerant circulating the chiller and cold water circulating between a cold water demand source and the chiller to cool the cold water. Since such a chiller is used for the purpose of large-scale air conditioning or the like, stable operation of the device is required.

The structure of a conventional chiller system is described as follows.

Referring to FIG. 1, the main configuration of a conventional chiller system 1 includes a compressor 10, a condenser 20, an expansion device 30, and an evaporator 40.

The compressor 10 is an apparatus for compressing gas such as air or refrigerant gas and is formed to compress the refrigerant and provide it to the condenser 20.

The impeller 11 used in the compressor 10 compresses air by accelerating the air introduced in the shaft direction through the shroud and discharging the air in the radial direction between the blades. Such an impeller 11 is formed of a synthetic resin or metal material.

Conventionally, the impeller 11 is manufactured by a brazing method in which a shroud formed by numerical control (NC) processing and a module in which a hub and a blade are integrally formed are coupled by an adhesive method, or the impeller 11 is manufactured by a casting method produced by casting, or the impeller 11 is manufactured by a rivet fastening method of assembling a shroud, a blade, and a hub made in the form of sheet metal through a rivet.

In the case of the brazing method, since all the components of the impeller 11 are formed by NC processing, there is a problem that the manufacturing cost is high, and the adhesion inspection of the shroud and the module is limited.

Meanwhile, in the case of the casting method, since it is impossible to check the shape of flow path of the impeller 11, there is a problem that it is difficult to check the performance quality of the impeller 11.

Meanwhile, in the case of the rivet fastening method, there is a problem that it is difficult to apply to the impeller 11 rotating at high speed.

SUMMARY OF THE INVENTION

The present disclosure has been made in view of the above problems, and provides an impeller that has increased structural strength by having a structure in which blades having protrusions on both sides are coupled to grooves formed in a shroud and a hub.

Meanwhile, the present disclosure further provides an impeller that has increased structural strength by having a shroud including at least one circular rib on an upper surface.

Meanwhile, the present disclosure further provides an impeller having a structure in which a sheet metal-processed blade is coupled to NC-processed shroud and hub, thereby reducing manufacturing cost.

Meanwhile, the present disclosure further provides a method of manufacturing an impeller that is easy to check and inspect a coupled state, by including a shroud and a hub having at least one hole structure in which the blade is coupled to the shroud or the hub.

Meanwhile, the present disclosure further provides a method of manufacturing an impeller capable of minimizing the deformation of a product due to assembly, by performing a heat treatment process on the shroud, blade and hub that are provisionally coupled.

In accordance with an aspect of the present disclosure, an impeller includes: a hub in which a plurality of spiral first slots are formed; a shroud which is positioned opposite the hub, and has a plurality of spiral second slots formed therein; and a plurality of blades which is coupled to the hub and the shroud, and have an upper protrusion formed on one side and a lower protrusion formed on the other side; and wherein the upper protrusion is inserted into and coupled to a second hole formed in the second slot, and the lower protrusion is inserted into and coupled to a first hole formed in the first slot.

The shroud, the hub, and the blade are formed of an aluminum alloy.

The strength of the shroud is higher than that of the blade and the hub.

A sum of a height of the upper protrusion and a depth of the second slot is greater than or equal to a thickness of the shroud, and a sum of a height of the lower protrusion and a depth of the first slot is greater than or equal to a thickness of the hub.

The upper protrusion and the lower protrusion are formed to be spaced apart from a front edge (FE) and a rear edge (RE) of the blade by at least a certain distance.

The shroud includes at least one rib formed to be circularly spaced apart from each other on an upper surface.

The at least one rib is formed to have a thicker thickness as it is located closer to a suction port of the shroud.

The impeller further includes a coupling member which is injected between the upper protrusion and the second hole, and injected between the lower protrusion and the first hole.

The blade is formed by sheet metal processing, and the shroud and the hub are formed by a numerical control (NC) processing.

The coupling is a welding coupling and achieved in a welding manner.

In accordance with another aspect of the present disclosure, a method of manufacturing an impeller includes: a first step of forming a hub in which a plurality of spiral first slots are formed; a second step of forming a shroud in which a plurality of spiral second slots are formed; a third step of forming at least one blade having an upper protrusion formed on one side and a lower protrusion formed on the other side; a fourth step of inserting the lower protrusion into a first hole of the hub; a fifth step of inserting the upper protrusion into a second hole of the shroud; and a sixth step of performing welding processing at a point where the upper protrusion and the second hole are coupled, and at a point where the lower protrusion and the first hole are coupled.

After the sixth step, the method of manufacturing an impeller further includes a seventh step of performing a heat treatment process for the coupled shroud, blade and hub.

The third step is a step of forming the blade by sheet metal processing, and the first step and the second step are a step of forming the hub and the shroud by NC processing.

The fourth to sixth steps are a step of being performed by using a provisional assembly zig.

BRIEF DESCRIPTION OF THE DRAWINGS

The above and other objects, features and advantages of the present disclosure will be more apparent from the following detailed description in conjunction with the accompanying drawings, in which.

DETAILED DESCRIPTION OF THE PREFERRED EMBODIMENTS

Description will now be given in detail according to exemplary embodiments disclosed herein, with reference to the accompanying drawings. For the sake of brief description with reference to the drawings, the same or equivalent components may be denoted by the same reference numbers, and description thereof will not be repeated. In general, suffixes such as "module" and "unit" may be used to refer to elements or components. Use of such suffixes herein is merely intended to facilitate description of the specification, and the suffixes do not have any special meaning or function. In the present disclosure, that which is well known to one of ordinary skill in the relevant art has generally been omitted for the sake of brevity. The accompanying drawings are used to assist in easy understanding of various technical features and it should be understood that the embodiments presented herein are not limited by the accompanying drawings. As such, the present disclosure should be construed to extend to any alterations, equivalents and substitutes in addition to those which are particularly set out in the accompanying drawings. It will be understood that although the terms first, second, etc. may be used herein to describe various elements, these elements should not be limited by these terms. These terms are only used to distinguish one element from another. It will be understood that when an element is referred to as being "connected with" another element, there may be intervening elements present. In contrast, it will be understood that when an element is referred to as being "directly connected with" another element, there are no intervening elements present. A singular representation may include a plural representation unless context clearly indicates otherwise. Terms such as "includes" or "has" used herein should be considered as indicating the presence of several components, functions or steps, disclosed in the specification, and it is also understood that more or fewer components, functions, or steps may likewise be utilized.

Figure 1:
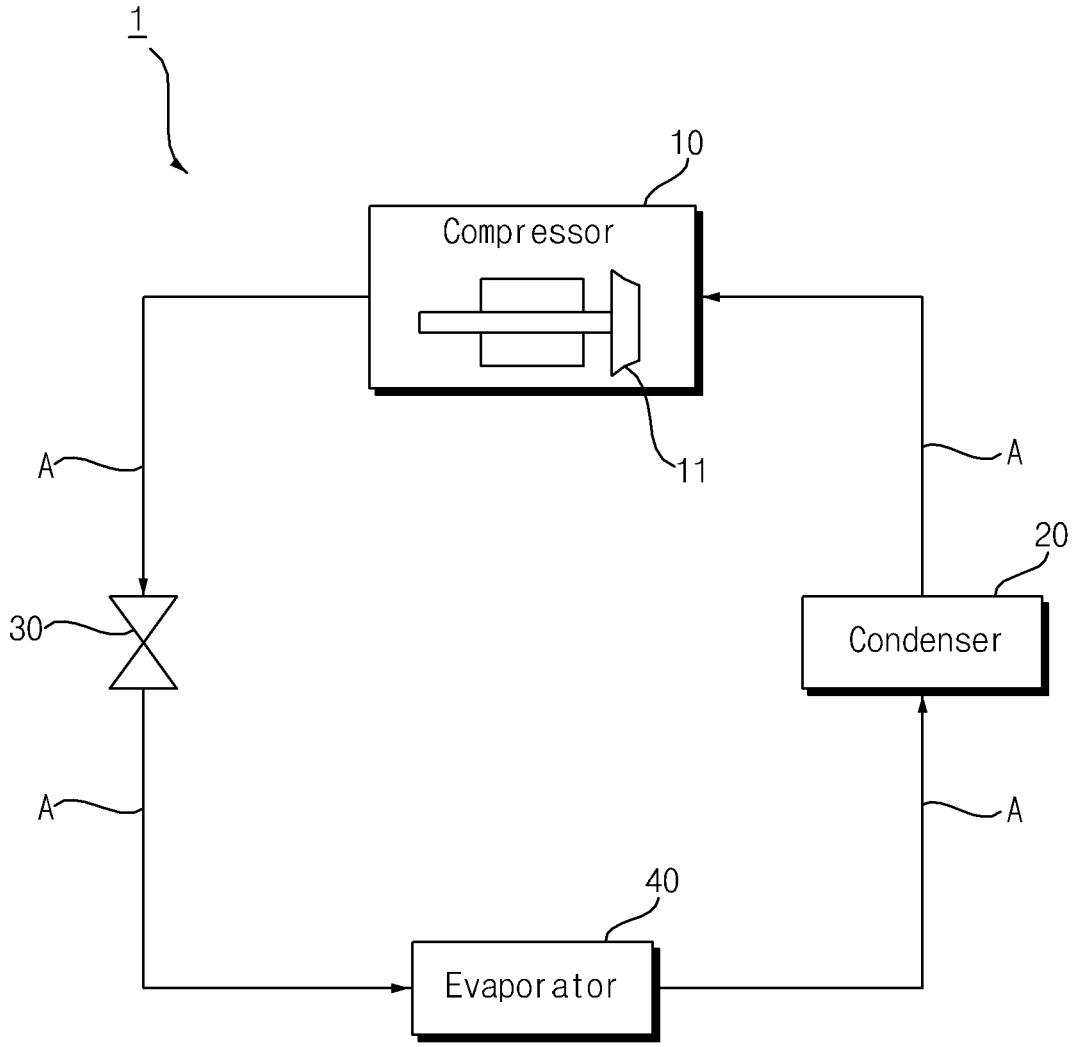
FIG. 1 is a view showing a conventional general chiller and a compressor and impeller included therein.
Figure 2:
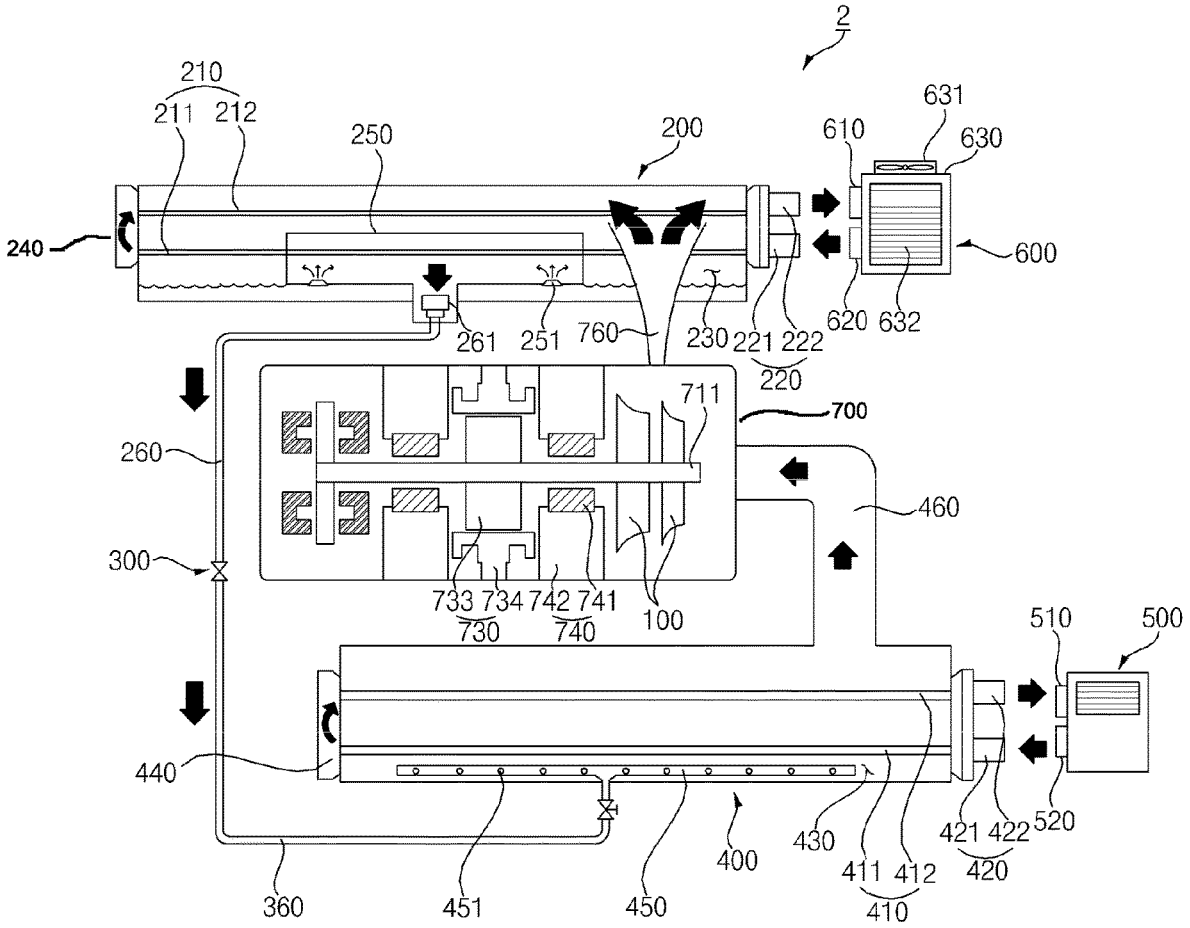
FIG. 2 is a view showing a chiller including an impeller according to an embodiment of the present disclosure.

FIG. 2 is a view showing a chiller 2 including an impeller 100 according to an embodiment of the present disclosure.

Meanwhile, the impeller 100 according to an embodiment of the present disclosure may not only function as a part of a chiller system, but also be included in an air conditioner, and may be included in any device that compresses a gaseous material.

Referring to FIG. 2, the chiller 2 including the impeller 100 according to an embodiment of the present disclosure may include a compressor 700 formed to compress a refrigerant, a condenser 200 for condensing the refrigerant by heat exchange between the refrigerant compressed in the compressor 700 and cooling water, an expander 300 that expands the refrigerant condensed in the condenser 200, and an evaporator 400 formed to cool the cold water together with the evaporation of the refrigerant by heat exchange between the cold water and the refrigerant expanded in the expander 300.

Meanwhile, the chiller 2 may further include a cooling water unit 600 formed to cool the cooling water that exchanged heat with the refrigerant in the condenser 200, and an air conditioning unit 500 that cools the air in an air conditioning space by heat-exchange between the cold water cooled in the evaporator 400 and the air in the air conditioning space.

The condenser 200 may provide a place for exchanging the heat of high-pressure refrigerant compressed by the compressor 700 with cooling water introduced from the cooling water unit 600. The compressed high-pressure refrigerant is condensed through heat exchange with cooling water.

The condenser 200 may be configured of a shell-tube type heat exchanger. Specifically, the high-pressure refrigerant compressed by the compressor 700 flows into a condensing space 230 corresponding to the internal space of the condenser 200 through a condenser connection passage 760. In addition, the condensation space 230 may include a cooling water flow path 210 through which cooling water flowing from the cooling water unit 600 flows.

The cooling water passage 210 may include a cooling water inflow passage 211 through which cooling water flows from the cooling water unit 600 and a cooling water discharge passage 212 through which cooling water is discharged to the cooling water unit 600. The cooling water flowing into the cooling water inflow passage 211 exchanges heat with the refrigerant in the condensation space 230, and then passes through the cooling water connection passage 240 provided in one end of the condenser 200 or outside the condenser 200 and flows into the cooling water discharge passage 212.

The cooling water unit 600 and the condenser 200 may be connected via a cooling water tube 220. The cooling water tube 220 may be a passage through which cooling water flows between the cooling water unit 600 and the condenser 200. In addition, the cooling water tube 220 may be made of a material such as rubber so that the cooling water does not leak to the outside.

The cooling water tube 220 may be composed of a cooling water inflow tube 221 connected to the cooling water inflow passage 211 and a cooling water discharge tube 222 connected to the cooling water discharge passage 212.

In the overall flow of the cooling water, the cooling water that has completed heat exchange with air or liquid in the cooling water unit 600 flows into the condenser 200 through the cooling water inflow tube 221. The cooling water introduced into the condenser 200 sequentially passes through the cooling water inflow passage 211, the cooling water connection passage 240, and the cooling water discharge passage 212 provided in the condenser 200 and exchanges heat with the refrigerant flowed into the condenser 200, and then passes through the cooling water discharge tube 222 again and flows into the cooling water unit 600.

Meanwhile, the cooling water unit 600 may air-cool the cooling water absorbed the heat of the refrigerant through heat exchange in the condenser 200. The cooling water unit 600 may include a main body 630, a cooling water inflow pipe 610 which is an inlet through which the cooling water absorbed heat is introduced through the cooling water discharge tube 222, and a cooling water discharge pipe 620 that is an outlet through which the cooling water is discharged after being cooled inside the cooling water unit 600.

The cooling water unit 600 may use air to cool the cooling water introduced into the main body 630. Specifically, the main body 630 may include a fan for generating air flow, and may include an air outlet 631 through which air is discharged and an air inlet 632 corresponding to an inlet through which air is introduced into the main body 630.

The air that is discharged from the air outlet 631 after heat exchange is completed may be used for heating. The refrigerant that completed heat-exchange in the condenser 200 is condensed and accumulated in the lower portion of the condensation space 230. The accumulated refrigerant flows into the expander 300 after flowing into a refrigerant box 250 provided in the condensation space 230.

The refrigerant box 250 may include a refrigerant inlet 251. The refrigerant flowing into the refrigerant inlet 251 is discharged through an expansion device connection passage 260. The expansion device connection passage 260 may include an expansion device connection passage inlet 261, and the expansion device connection passage inlet 261 may be located in the lower portion of the refrigerant box 250.

The evaporator 400 may include an evaporation space 430 in which heat exchange occurs between the refrigerant expanded in the expander 300 and cold water. The refrigerant passed through the expander 300 in the expansion device connection passage 260 flows through the evaporator connection passage 360 to the refrigerant spray device 450 provided in the evaporator 400, and is spread evenly into the evaporator 400 through a refrigerant spray hole 451 provided in the refrigerant spray device 450.

In addition, inside the evaporator 400, a cold water passage 410 including a cold water inflow passage 411 through which cold water flows into the evaporator 400 and a cold water discharge passage 412 through which cold water is discharged to the outside of the evaporator 400 is provided.

Cold water is introduced or discharged through a cold water tube 420 that communicates with the air conditioning unit 500 provided outside the evaporator 400. The cold water tube 420 may include a cold water inflow tube 421 that is a passage for cold water inside the air conditioning unit 500 to the evaporator 400, and a cold water discharge tube 422 that is a passage for cold water that completed heat-exchange in the evaporator 400 to the air conditioning unit 500. That is, the cold water inflow tube 421 is in communication with the cold water inflow passage 411 and the cold water discharge tube 422 is in communication with the cold water discharge passage 412.

In the flow of cold water, the cold water passes through the air conditioning unit 500, the cold water inflow tube 421, and the cold water inflow passage 411, passes through a cold water connection passage 440 provided in the inner end of the evaporator 400 or outside the evaporator 400, and then flows back into the air conditioning unit 500 through the cold water discharge passage 412 and the cold water discharge tube 422.

The air conditioning unit 500 may exchange heat between cold water cooled in the evaporator 400 and air in the air conditioning space. The cold water cooled in the evaporator 400 absorbs heat of air in the air conditioning unit 500 to enable indoor cooling. The air conditioning unit 500 may include a cold water discharge pipe 520 communicating with the cold water inflow tube 421 and a cold water inflow pipe 510 communicating with the cold water discharge tube 422. The refrigerant that completed heat exchange in the evaporator 400 flows back into a compressor 700 through a compressor connection passage 460.

In the flow of the refrigerant, the refrigerant flowing into the compressor 700 through the compressor connection passage 460 is compressed toward the circumference by the action of the impeller 100 and then discharged into the condenser connection passage 760. The compressor connection passage 460 may be connected to the compressor 700 so that the refrigerant flows in a direction perpendicular to the rotation direction of the impeller 100.

The compressor 700 may include the impeller 100 according to an embodiment of the present disclosure, a motor 730 that is accommodated in the motor housing and rotates, a rotation shaft 711 to which the impeller 100 and the motor 730 for rotating the impeller 100 are connected, a bearing part 740 including a plurality of bearings 741 for supporting the rotation shaft 711 to be rotatable in the air and a bearing housing 742 for supporting the bearing 741, and a gap sensor (not shown) for sensing the distance to the rotation shaft 711.

The impeller 100 may be composed of one or two stages, and may be formed of a plurality of stages. The impeller 100 rotates by the rotation shaft 711, and compresses the refrigerant introduced in the shaft direction due to rotation in the centrifugal direction, thereby making the refrigerant high pressure.

The motor 730 may be configured of a stator 734 and a rotor 733 to rotate the rotation shaft 711. The rotor 733 may be disposed in the outer circumference of the rotation shaft 711 and may be rotated together with the rotation shaft 711. The stator 734 may be disposed inside the motor housing to surround the outer circumference of the rotor 733. The motor 730 may have a structure that has a rotation shaft separate from the rotation shaft 711 and transmits rotational force to the rotation shaft 711 by a belt (not shown).

The rotation shaft 711 may be connected to the impeller 100 and the motor 730. The rotation shaft 711 extends in the left-right direction of FIG. 2. When the bearing 741 is a magnetic bearing, it is preferable that the rotation shaft 711 includes metal so that the rotation shaft 711 can be moved by magnetic force.

When the bearing 741 is a magnetic bearing, the bearing 741 may be composed of a conductor, and a coil (not shown)

may be wound. In this case, the bearing 741 acts like a magnet by the current flowing through the wound coil.

A plurality of bearings 741 may be provided around the rotation shaft 711 to surround the rotation shaft 711. The rotation shaft 711 is floated in the air by the magnetic force generated by the coil wound around the bearing 741.

Figure 3A:
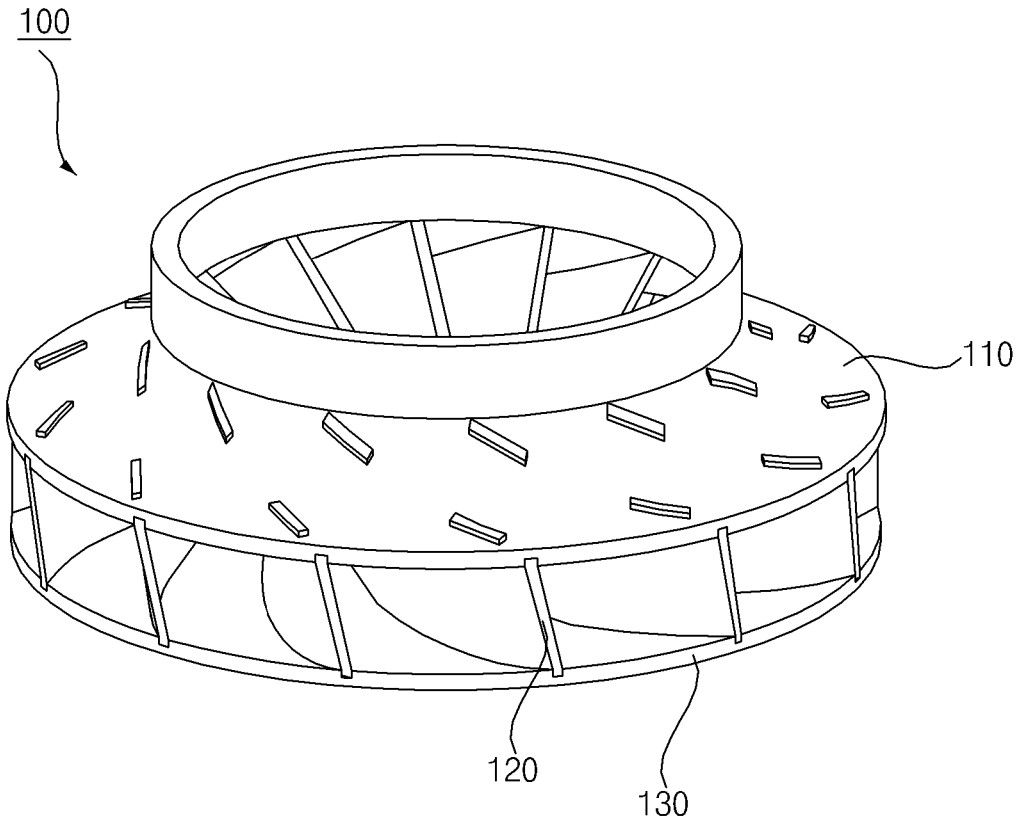
FIGS. 3A and 3B are views showing an impeller according to an embodiment of the present disclosure.
Figure 3B:
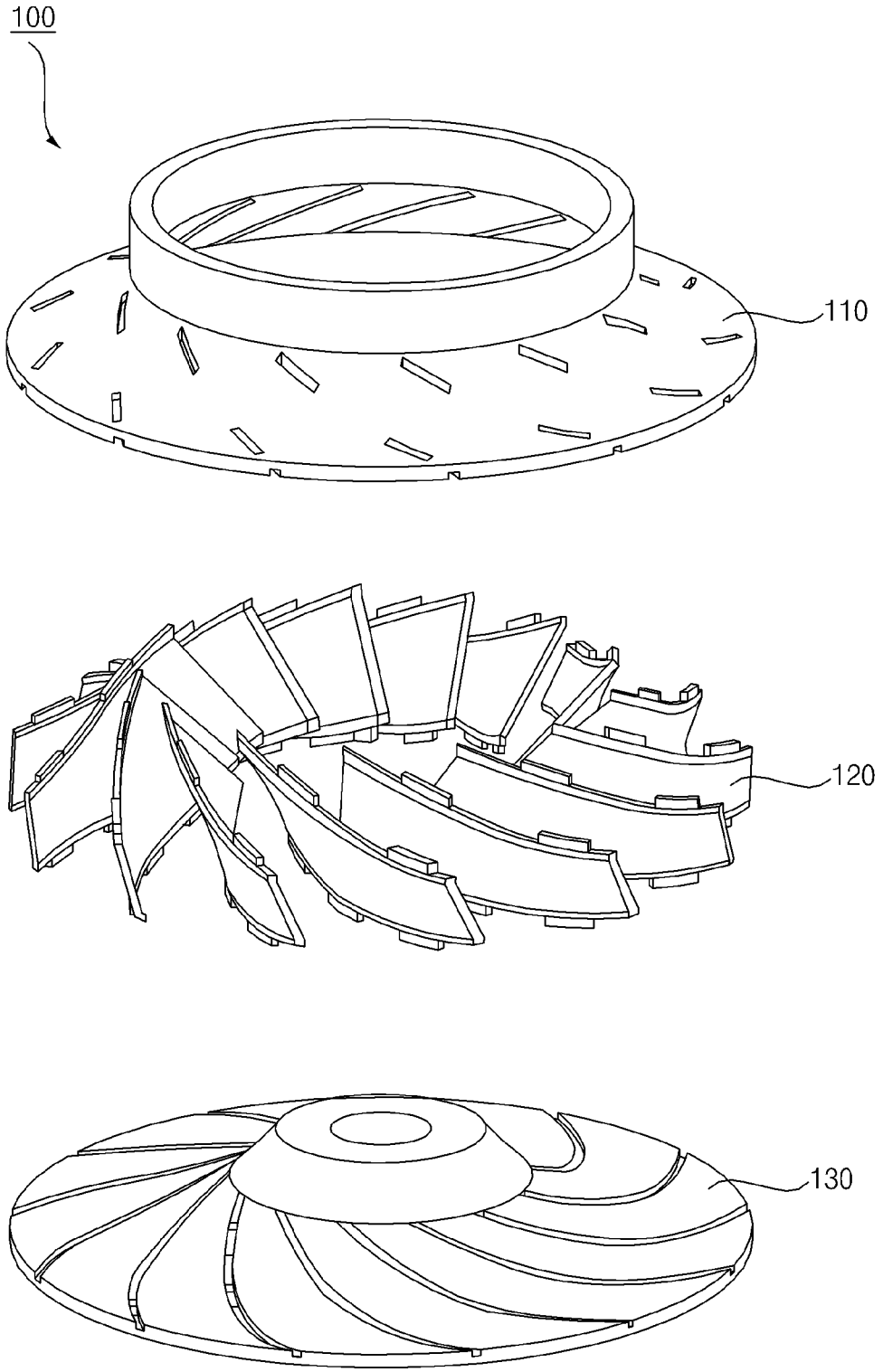

FIGS. 3A and 3B are views showing an impeller 100 according to an embodiment of the present disclosure. FIG. 3A is a perspective view of the impeller 100 and FIG. 3B is an exploded perspective view of the impeller 100.

Referring to the drawings, the impeller 100 according to an embodiment of the present disclosure may include a shroud 110, a hub 130, and a plurality of blades 120.

The shroud 110, the blade 120, and the hub 130 are manufactured respectively, and the blade 120 may be coupled to the shroud 110 and the hub 130.

Materials of the shroud 110, the hub 130, and the plurality of blades 120 of the impeller 100 may be formed of a metal material having plasticity. For example, the shroud 110, the hub 130, and the plurality of blades 120 may be made of an aluminum alloy.

Meanwhile, the strength of the shroud 110 may be higher than that of the blade 120 and the hub 130.

When the impeller 100 rotates, the shroud 110 may receive a stronger pressure than the blade 120 and the hub 130 by the fluid flowing into the impeller 100. Accordingly, it is preferable that the material constituting the shroud 110 has higher strength than the material constituting the blade 120 and the hub 130.

For example, the shroud 110 may be made of A7075-T6 aluminum alloy, and the blade 120 and hub 130 may be made of A6061-T6 aluminum alloy. However, the material of the shroud 110, the blade 120, and the hub 130 is not limited thereto.

A6061-T6 aluminum alloy is a precipitation-hardening alloy and is one of the heat-treated alloys. A6061 T6 aluminum alloy has excellent corrosion resistance, weldability, and excellent extrusion processability.

A7075-T6 aluminum alloy is one of the alloys having the highest strength among aluminum alloys, and has a higher strength than A6061-T6 aluminum alloy.

Accordingly, it is possible to increase the durability of the impeller 100 by using a material having higher strength for the shroud 110 to which a strong pressure is applied.

The impeller 100 may be formed in a form in which the shroud 110 and the hub 130 are positioned to face each other, and a plurality of blades 120 are coupled between the shroud 110 and the hub 130. One side of the plurality of blades 120 may be coupled with the lower surface of the shroud 110, and the other side may be coupled with the upper surface of the hub 130.

The shroud 110 and the hub 130 may have a circular shape so as to be suitable for rotation about the rotation shaft 711. The plurality of blades 120 may be coupled with the shroud 110 and the hub 130 to form a flow path of fluid compressed and discharged through the impeller 100.

Figure 4:
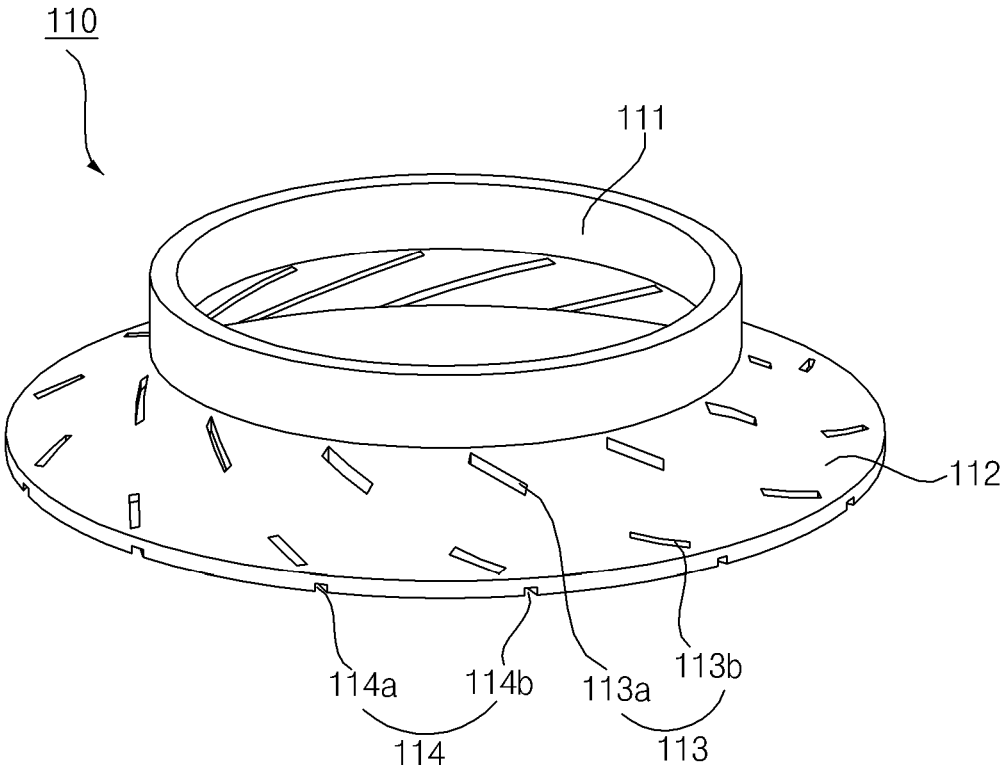
FIG. 4 is a view illustrating a shroud included in the impeller of FIG. 3A.

FIG. 4 is a view illustrating a shroud 110 included in the impeller of FIG. 3A.

The shroud 110 is disposed to be spaced apart from the hub 130. The shroud 110 has a circular ring shape in which a suction port 111 is formed in the center, and consists of a suction port 111 and a shroud body part 112.

The suction port 111 may be formed to allow air to flow in the direction of the rotation shaft 711. The suction port 111 may have a shape protruding from the center of the shroud body part 112 toward the direction in which the fluid is introduced.

The shroud body part 112 supports an upper edge 1216 of the blade 120. The shroud body part 112 gradually expands in the radial direction from the inner circumference forming the suction port 111 and has a maximum diameter at the outer circumference from which the airflow pushed by the blade 120 is discharged.

The shroud body part 112 may form a curved surface in which the inner surface through which the fluid is guided is convexly curved toward the hub 130. Accordingly, the shroud 110 can smooth the fluid flow and minimize energy loss due to the fluid flow.

A plurality of spiral second slot portions 114 may be formed in the bottom surface of the shroud body part 112. The second slot portion 114 may have a shape in which the surface of the bottom surface of the shroud body part 112 is recessed in an intaglio shape.

At least one second hole 113 may be formed in each of the second slots 114 to be spaced apart from each other. The shape of the second hole 113 may be a shape formed so that a part of the spiral shape of the second slot portion 114 penetrates the shroud body part 112. In addition, the second hole 113 may have the same shape as an upper protrusion 1214 of the blade 120.

The second slot portion 114 formed in the shroud 110 may have the same spiral shape as that of the blade 120. Accordingly, the shroud 110 may be coupled with a plurality of blades 120 in a form in which one side of one blade 120 is seated in one second slot portion 114.

Meanwhile, the shroud 110 may be formed by numerical control NC processing. Numerical control processing is a processing performed by controlling processing conditions with a computer device. Since the numerical control processing is controlled by a program, it has an advantage that it can be used for processing a complex shape.

To this end, an NC processing apparatus equipped with a dedicated program for shape processing of the shroud 110 may be used.

Meanwhile, the shroud 110 may be formed by various processing methods such as sheet metal processing.

FIG. 5 is a view showing the structure of a blade 120 included in the impeller 100 of FIG. 3A.

Figure 5A:
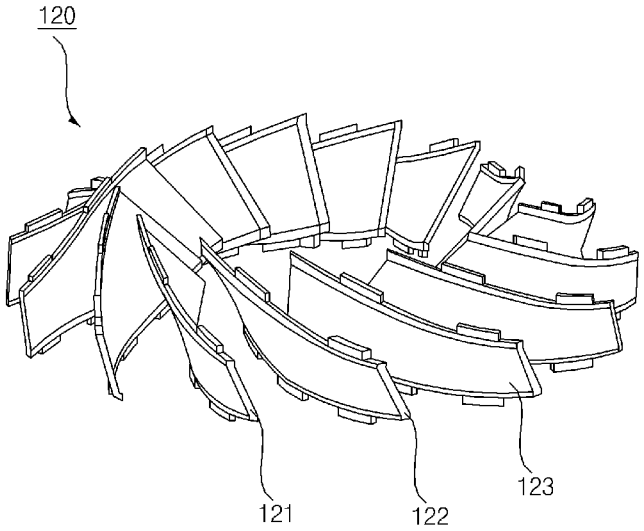
FIGS. 5A and 5B are views showing the structure of a blade included in the impeller of FIG. 3A.

Referring to FIG. 5A, the impeller 100 may include a plurality of blades 120. The plurality of blades 121, 122, 123 are coupled to the shroud 110 and the hub 130.

The body part of the adjacent two blades 121 and 122 may form a flow path for fluid discharged from the impeller 100 together with the lower surface of the shroud 110 and the upper surface of the hub 130.

A plurality of blades 120 are disposed along the circumferential direction between the hub 130 and the shroud 110. Specifically, a plurality of blades 120 may be disposed spaced apart from each other at a certain interval around the rotation shaft 711.

The blade 120 may be formed in a form bent according to the rotation direction in order to transmit the rotational kinetic energy generated by the impeller 100 to the fluid. The fluid sucked through a suction port 111 of the shroud 110 flows from a front edge (FE) 1212 of the blade 120 to a rear edge (RE) 1213, and is discharged.

In a cross section orthogonal to the rotation shaft 711, the front edge 1212 of the blade 120 may be located in a certain common inner circumference, and the rear edge 1213 of the blade 120 may be located in a certain common outer circumference having a larger diameter than the inner circumference.

Figure 5B:
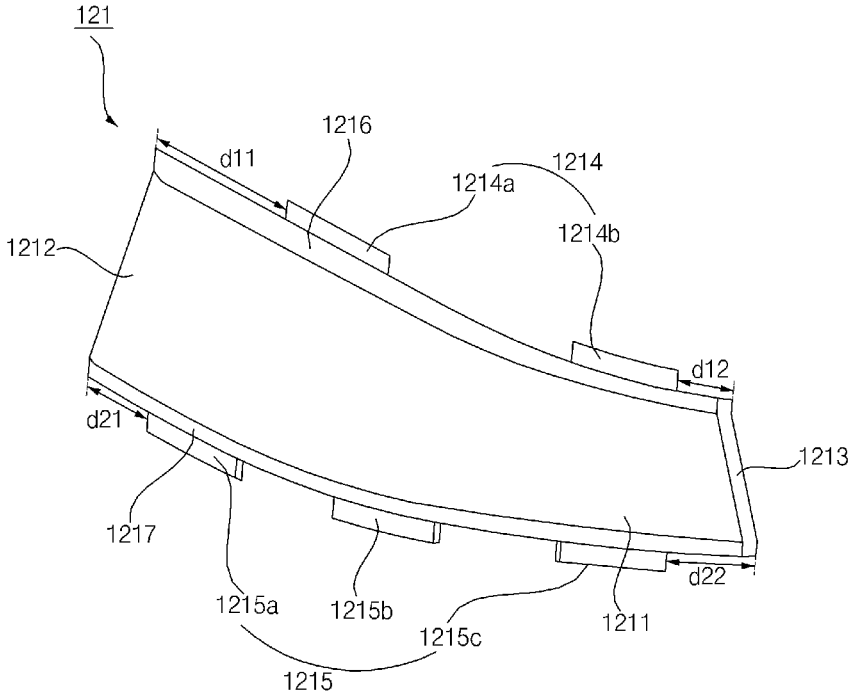

Referring to FIG. 5B, the blade 120 may include a body portion 1211, a front edge 1212, a rear edge 1213, an upper edge 1216, and a lower edge 1217.

Meanwhile, the blade 120 may further include at least one upper protrusion 1214 formed to be spaced apart from each other in one side of the upper edge 1216 and at least one lower protrusion 1215 formed to be spaced apart from each other in one side of the lower edge 1217.

The upper edge 1216 has the same spiral shape as the second slot portion 114 of the shroud 110, and may be seated and coupled to the second slot portion 114.

The lower edge 1217 has the same helical shape as a first slot portion 134 of the hub 130, and may be seated and coupled to the first slot portion 134.

The upper protrusion 1214 may be inserted into and welding coupled to a first hole 133 formed in the first slot portion 134, and the lower protrusion 1215 may be inserted into and welding coupled to a second hole 113 formed in the second slot 114.

The upper protrusion 1214 may have the same shape as the second hole 113, and the lower protrusion 1215 may have the same shape as the first hole 133.

Meanwhile, the welding coupling may be achieved in a welding manner. The welding manner is performed at a temperature of 450 degrees or higher, and is a method of bonding above the melting point of a base metal to be bonded. However, the welding coupling may be a brazing method that is performed at a temperature of 450 degrees or higher and accomplishes bonding below the melting point of the base material, but is not limited thereto.

Meanwhile, the upper protrusion 1214 and the lower protrusion 1215 of the blade 120 may be separated from the front edge FE 1212 of the blade 120 and the rear edge RE 1213 of the blade 120 by a certain distance or more.

When the upper protrusion 1214 or the lower protrusion 1215 is formed adjacent to the front edge 1212 or the rear edge 1213 within a certain distance, thermal deformation may occur during the welding process of the shroud 110 and the blade 120 or the hub 130 and the blade 120.

The distance d11 between the front edge 1212 and the upper protrusion 1214*a* closest to the front edge 1212 and the distance d12 between the rear edge 1213 and the upper protrusion 1214*b* closest to the rear edge 1213 may be a set separation distance or more. In addition, the distance d21 between the front edge 1212 and the lower protrusion 1215*a* closest to the front edge 1212 and the distance d22 between the rear edge 1213 and the lower protrusion 1215*c* closest to the rear edge 1213 may be a set separation distance or more.

For example, the set separation distance may be at least 10 mm or more. However, the value of the separation distance is not limited thereto.

Meanwhile, the number of upper protrusions 1214 and the number of lower protrusions 1215 may be different from each other. For example, referring to the drawing, two upper protrusions 1214 may be formed, and three lower protrusions 1215 may be formed. However, the number of protrusions is not limited thereto.

Meanwhile, the blade 120 may be formed by pressing a metal plate or processing a sheet metal. Sheet metal processing is a processing method of making a product of a desired shape through operations such as bending, folding, drilling, and cutting.

Specifically, the blade 120 may be formed by press molding a plastic metal plate. Aluminum alloys can be easily molded into various forms and secure corrosion resistance, heat resistance, and rigidity according to the content ratio of materials forming the alloy.

For example, the blade 120 may be made of an A6061-T6 aluminum alloy. Since A6061-T6 aluminum alloy has excellent extrusion processability, it is suitable for sheet metal processing.

Accordingly, the blade 120 not only can secure sufficient rigidity, but also can be implemented in a complex shape for improving the performance of the impeller 100.

Meanwhile, the blade 120 may be formed by various processing methods such as numerical control processing.

Figure 6:
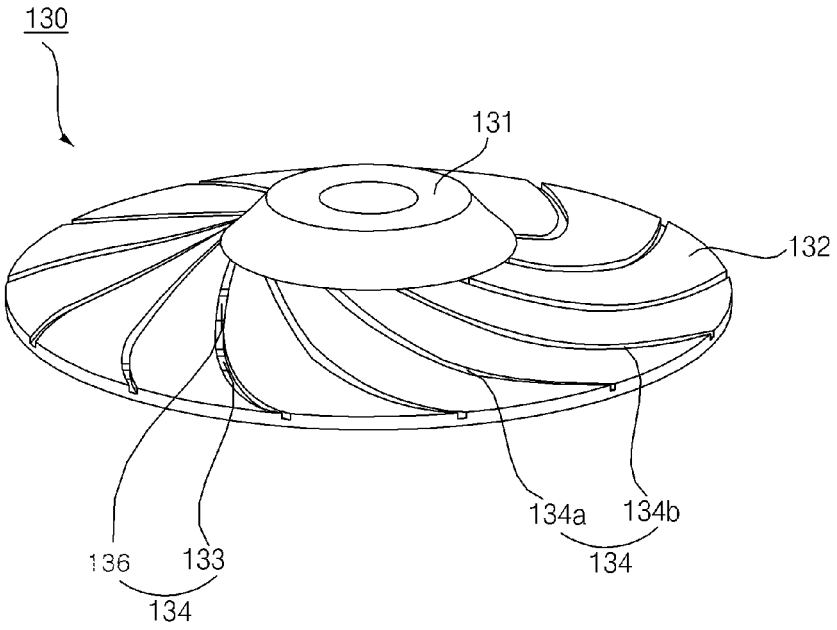
FIG. 6 is a view showing the structure of a hub included in the impeller of FIG. 3A.

FIG. 6 is a view showing the structure of a hub 130 included in the impeller 300 of FIG. 3A.

The hub 130 rotates about the rotation shaft 711 by the motor 730. According to an embodiment, the hub 130 may be directly connected to the rotation shaft 711 of the motor 730.

The hub 130 is disposed to be spaced apart from the shroud 110. The hub 130 is formed in a circular ring shape, and gradually expands in the radial direction from the inner circumference forming a shaft connection part 131, and has a maximum diameter at the outer circumference from which the airflow pushed by the blade 120 is discharged.

The hub 130 may include a blade support plate 132 for supporting the lower edge 1217 of the blade 120 and a shaft connection part 131 protruding from the center of the blade support plate 132 toward the shroud 110.

The shaft connection part 131 extends with a certain curvature from the blade support plate 132. A hole is formed in the center of the shaft connection part 131 to be coupled to the rotation shaft 711 of the motor 730, and a plurality of fastening holes (not shown) along the circumference of the hole may be formed in the shaft connection part 131 at regular intervals along the circumferential direction. A fastening member such as a bolt or a screw is fastened through the fastening hole, so that the hub 130 may be connected to and fixed to the rotation shaft 711.

A plurality of spiral first slot portions 134 may be formed in the blade support plate 132 of the hub 130. The first slot portion 134 may have a shape that is recessed from the surface of the blade support plate 132 in an intaglio shape. The first slot portion 134 may include a groove 136 into which the lower edge 1217 is inserted and a first hole 133 into which the lower protrusion 1215 is inserted.

The groove 136 extends in a radial direction from the hub 130 and may be rounded to one side on a plane orthogonal to the shaft direction of the hub 130. A plurality first holes 133 may be disposed to be spaced apart from each other inside the groove 136.

At least one first hole 133 may be formed in each of the first slot portions 134 to be spaced apart from each other. The shape of the first hole 133 may be a shape formed so that a part of the spiral shape of the first slot portion 134 penetrates the blade support plate 132. In addition, the first hole 133 may have the same shape as the lower protrusion 1215 of the blade 120.

The first slot portion 134 may have the same spiral shape as that of the blade 120. Accordingly, the hub 130 may be coupled with a plurality of blades 120 in a form in which one side of one blade 120 is seated in one first slot portion 134.

Meanwhile, the hub 130 may be formed by numerical control processing. To this end, an NC processing apparatus equipped with a dedicated program for shape processing of the hub 130 may be used.

Meanwhile, the hub 130 may be formed by various processing methods such as sheet metal processing.

Meanwhile, the upper protrusion 1214 or the lower protrusion 1215 of the blade 120 may have a shape of a circular protrusion, and the second hole 113 of the shroud 110 or the first hole 133 of the hub 130 may have a shape of a hole passing through a cylindrical shape so as to be coupled with a circular protrusion. However, the shapes of the protrusion 1214, 1215 and the hole 113, 133 are not limited thereto, and may have various shapes according to embodiments.

Figure 7A:
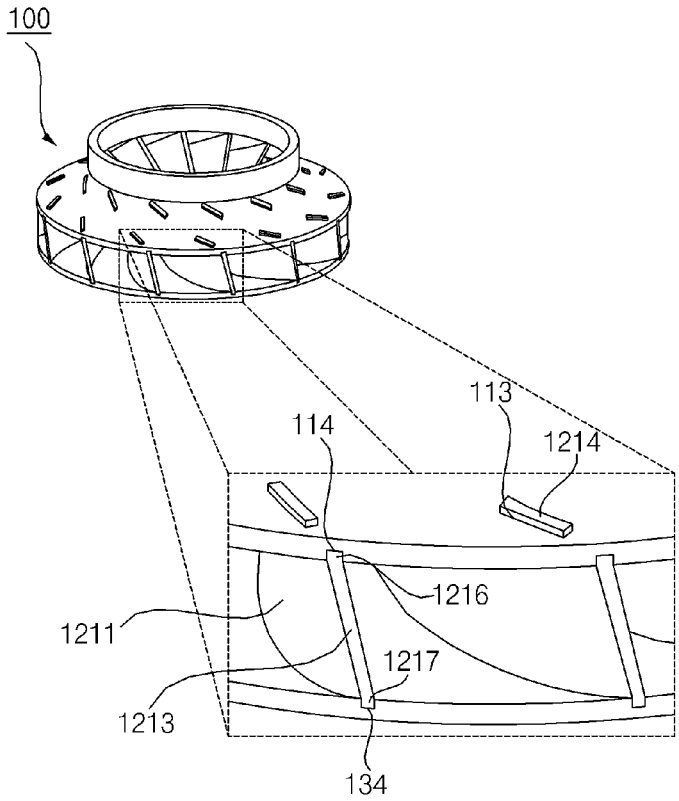
FIGS. 7A and 7B are views showing a coupling structure of a protrusion of the blade, a shroud, and a hub of FIG. 3A.
Figure 7B:
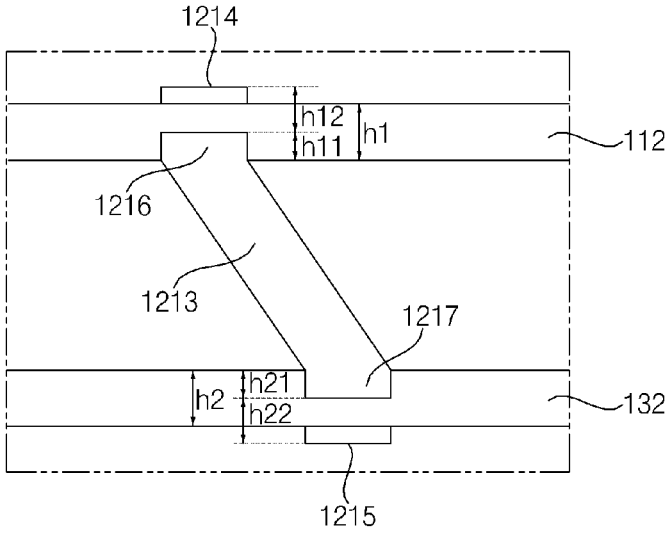

FIG. 7 is a view showing a coupling structure of a protrusion 1214, 1215 of the blade 120, a shroud 110, and a hub 130 of FIG. 3A.

Referring to FIG. 7, the upper edge 1216 and the upper protrusion 1214 of the blade 120 may be coupled to the second slot portion 114 and the second hole 113 of the shroud 110, respectively, and the lower edge 1217 and the lower protrusion 1215 of the blade 120 may be coupled to the first slot portion 134 and the first hole 133 of the hub 130, respectively.

The upper edge 1216 and the lower edge 1217 of the blade 120 are formed at both ends of the body 1213 and may be formed in a curved shape with the body 1213. The upper edge 1216 and the lower edge 1217 may have protruding directions parallel to each other.

The height of the upper edge 1216 may be equal to or greater than the depth h11 of the second slot portion 114, and the height of the lower edge 1217 may be equal to or greater than the depth h21 of the first slot portion 134.

The height h11 of the second slot portion 114 may be equal to or less than a certain ratio of the thickness h1 of the shroud body part 112, and the depth h21 of the first slot portion 134 may be equal to or less than a certain ratio of the thickness h2 of the blade support plate 132. For example, the depth h11 of the second slot portion 114 and the depth h21 of the first slot portion 134 may be equal to or less than 50% of the thickness h1 of the shroud body part 112 and the thickness h2 of the blade support plate 132, respectively.

Meanwhile, the sum of the height h12 of the upper protrusion 1214 and the depth h11 of the second slot portion 114 is greater than or equal to the thickness h1 of the shroud body part 112, and the sum of the height h22 of the lower protrusion 1215 and the depth h21 of the first slot portion 114 may be greater than or equal to the thickness h2 of the blade support plate 132.

In this case, when the upper protrusion 1214 is coupled with the shroud body part 112, a part of the upper protrusion 1214 may protrude above the shroud body part 112. Similarly, when the lower protrusion 1215 is coupled with the blade support plate 132, a part of the lower protrusion 1215 may protrude below the blade support plate 132.

When a part of the upper protrusion 1214 and the lower protrusion 1215 protrudes from the shroud body part 112 and the blade support plate 132, welding coupling may be easily achieved. Meanwhile, after welding coupling, the protruding portion may be cut by post-processing.

Meanwhile, the thickness h1 of the shroud body part 112 may be thicker than the thickness h2 of the blade support plate 132. In addition, the thickness h1 of the shroud body part 112 may be thicker than the width of the body part 1213. Accordingly, it is possible to increase the durability of the impeller 100 by forming a higher strength of the shroud 110 to which a strong pressure is applied.

Meanwhile, a coupling member may be injected between the upper protrusion 1214 and the second hole 113 and between the lower protrusion 1215 and the first hole 133. The coupling member may be injected in a fluid state.

In this case, the width and length of the upper protrusion 124 and the lower protrusion 1215 may be smaller than the width and length of the second hole 113 and the first hole 133, respectively.

The coupling member serves to join the upper protrusion 1214 and the second hole 113 and the lower protrusion 1215 and the first hole 133. When a coupling member is used, a welding method or a brazing method may be used for welding the coupling member and the shroud 110, the blade 120, and the hub 130.

Figure 8A:
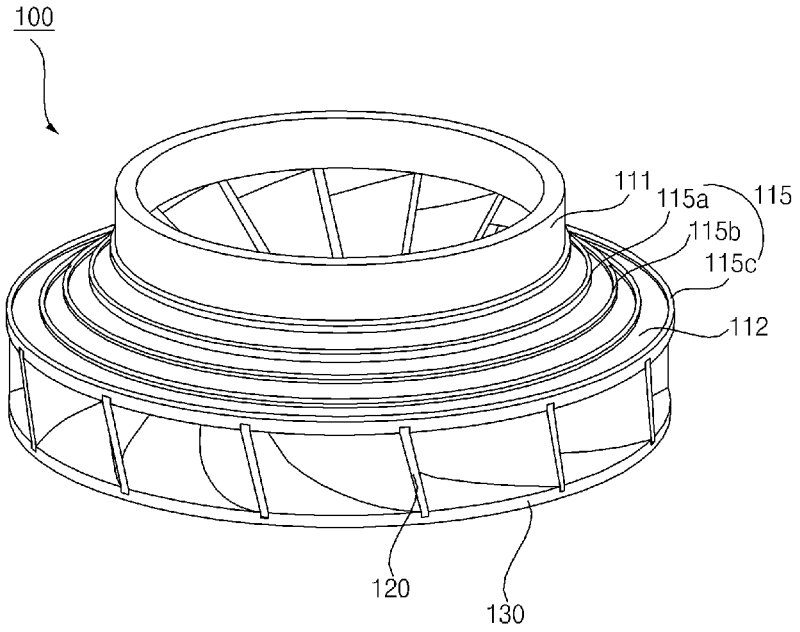
FIGS. 8A and 8B are views showing the shape of an impeller and a rib included therein according to another embodiment of the present disclosure.
Figure 8B:
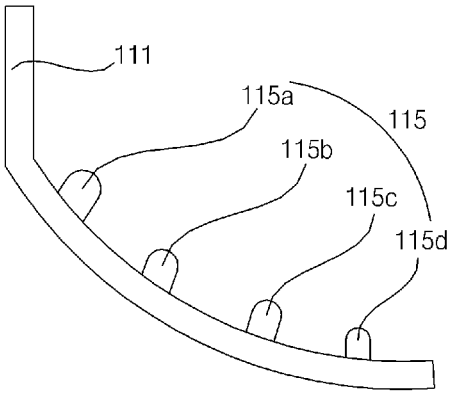

FIG. 8 is a view showing the shape of an impeller 100 and a rib 115 included therein according to another embodiment of the present disclosure.

Referring to FIG. 8, the shroud 110 may include at least one rib 115 on an upper surface of the shroud body part 112. At least one rib 115 may be formed to be circularly spaced apart from each other on an upper surface of the shroud body part 112.

The rib 115 may be made of metal of the same material as the shroud body part 112, and may be integrally formed with the shroud body part 112. When the rib 115 is formed, the strength of the shroud 110 may be increased.

Accordingly, it is possible to increase the durability of the impeller 100.

Meanwhile, as the at least one rib 115 is located closer to the suction port 111 of the shroud 110, the thickness or height may be increased.

Referring to FIG. 8, the thickness or height of the first rib 115*a* located closest to the suction port 111 is formed to be the largest, and the thickness or height may be formed to be smaller sequentially from a second rib 115*b* to a fourth rib 115*d*. Meanwhile, all of the at least one rib 115 may have the same thickness or height.

The cross section of the rib 115 may have a semi-circle or semi-ellipse shape. Since the rib 115 is formed on the upper surface of the shroud body part 112, the shape of the rib 115 does not affect the performance of the impeller 100. Accordingly, the cross section of the rib 115 may have various shapes, such as a triangle and a square, according to an embodiment.

Figure 9:
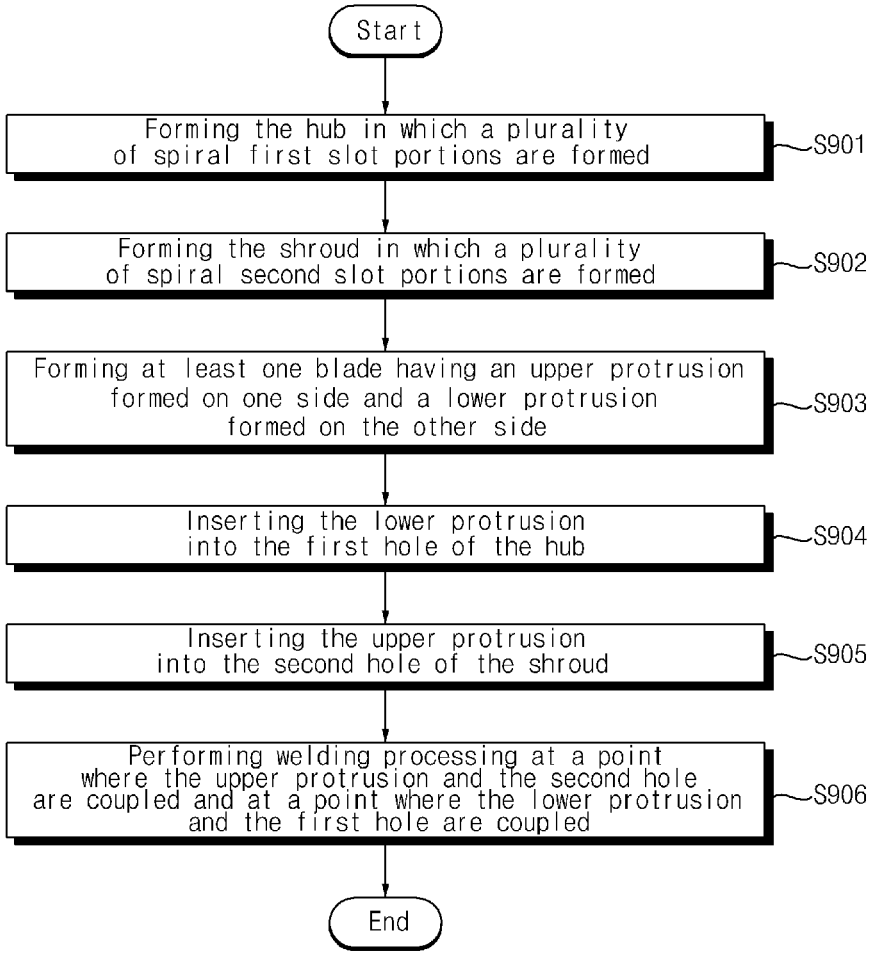
FIG. 9 is a view showing a flow chart of a method of manufacturing an impeller according to an embodiment of the present disclosure.

FIG. 9 is a view showing a flow chart of a method of manufacturing an impeller according to an embodiment of the present disclosure.

The method of manufacturing an impeller according to an embodiment of the present disclosure may include a first step (S901) of forming the hub 130 in which a plurality of spiral first slot portions 134 are formed, a second step (S902) of forming the shroud 110 in which a plurality of spiral second slot portions 114 are formed, a third step (S903) of forming at least one blade 120 having an upper protrusion 1214 formed on one side and a lower protrusion 1215 formed on the other side, a fourth step (S904) of inserting the lower protrusion 1215 into the first hole 133 of the hub 130, a fifth step (S905) of inserting the upper protrusion 1214 into the second hole 113 of the shroud 110, and a sixth step (S906) of performing welding processing at a point where the upper protrusion 1214 and the second hole 113 are coupled and at a point where the lower protrusion 1215 and the first hole 133 are coupled.

Meanwhile, the third step may be a step of forming the blade 120 by sheet metal processing, and the first step and the second step may be a step of forming the hub 130 and the shroud 110 by NC processing.

Since forming the shroud 110, the blade 120, and the hub 130 by sheet metal processing or NC processing is a general technology in the related art, a detailed description thereof will be omitted.

In the case of manufacturing the impeller 100 by coupling the NC-processed shroud 110 and the hub 130 with the sheet metal-processed blade 120, it is possible to reduce the manufacturing cost in comparison with the case of manufacturing the impeller 100 by forming the shroud 110, the blade 120, and the hub 130 using a five-shaft NC processing method or the like.

Meanwhile, fourth steps to sixth steps may be steps performed by using a zig for provisional assembly.

The provisional assembly zig (not shown) may have a structure including a hub fixing part for fixing the hub 130 and a shroud fixing part for fixing the shroud 110.

Here, the provisional coupling state means a state where the second slot portion 114 and the second hole 113 of the shroud 110 are fitted to the upper edge 1216 and the upper protrusion 1214 of the blade 120 respectively, and the first slot portion 134 and the first hole 133 of the hub 130 are fitted to the lower edge 1217 and the lower protrusion 1215 of the blade 120 respectively, and means a state before welding processing is performed.

The zig for provisional assembly may be maintained by fixing the shroud 110 and the hub 130 at regular intervals. To this end, the zig for provisional assembly may maintain a locked state through a screws or the like in a state in which the shroud 110, the blade 120, and the hub 130 are temporarily coupled, and when the zig is disassembled by unscrewing, the shroud 110, the blade 120, and the hub 130 can be easily disassembled.

Thus, by using the zig for provisional assembly, the positions of the shroud 110 and the hub 130 can be uniformly fixed to minimize concentricity, and the impeller 100 in which the height gap between the shroud 110 and the hub 130 is uniformly formed can be manufactured.

In a state in which the shroud 110, the blade 120, and the hub 130 are temporarily coupled, welding may be performed for the coupled portion.

To this end, the zig for provisional assembly may have a rotating structure. A welding processing may be performed for a portion where the upper protrusion 1214 of the blade 120 and the second hole 113 of the shroud 110 are fitted in a state where the upper surface of the shroud 110 faces upward, and then, a welding processing may be performed for a portion where the lower protrusion 1215 of the blade 120 and the first hole 133 of the hub 130 are fitted in a state where the zig rotates 180 degrees, and the lower surface of the hub 130 faces upward.

Accordingly, it is possible to easily check the coupling state of the shroud 110, the blade 120, and the hub 130, and it is possible to easily examine the welding state.

Meanwhile, when the provisional coupling is performed while the zig for provisional assembly is rotated 180 degrees, the order of the fourth step and the fifth step may be changed.

Meanwhile, after the sixth step, the method of manufacturing an impeller according to an embodiment of the present disclosure may further include a seventh step of performing a heat treatment process for the coupled shroud 110, blade 120, and hub 130.

In the process of welding the shroud 110 and the blade 120 or welding the hub 130 and the blade 120, deformation may occur or concentration of stress may occur in part of the shroud 110, the blade 120, and the hub 130 due to welding heat.

Therefore, after welding processing, a heat treatment process is performed for the coupled shroud 110, blade 120, and hub 130, so that the deformation caused by welding can return to its original shape, and residual stress can be removed, or the stress concentrated in a specific part can be relieved.

In the heat treatment process, the welding bonded shroud 110, blade 120 and hub 130 are introduced into the inside of a furnace, and the inside of the furnace is heated or cooled, or maintained within a certain temperature range for a certain time. However, the method of the heat treatment process is not limited thereto.

The impeller 100, the chiller 2 including the same, and the method of manufacturing the impeller according to the present disclosure are not limited to the configuration and method of the embodiments described above, but all or part of each of the embodiments may be selectively combined and configured so that the embodiments may be variously modified.

According to the present disclosure, there are the following effects.

The impeller according to an embodiment of the present disclosure has a structure in which blades having protrusions on both sides are coupled to grooves formed in a shroud and a hub, thereby increasing structural strength.

Meanwhile, the impeller according to an embodiment of the present disclosure includes a shroud including at least one circular rib on the upper surface, thereby increasing structural strength.

Meanwhile, the impeller according to an embodiment of the present disclosure has a structure in which a sheet metal-processed blade is coupled to an NC-processed shroud and hub, thereby reducing manufacturing cost.

Meanwhile, the method of manufacturing an impeller according to an embodiment of the present disclosure accomplishes welding coupling by using at least one hole in which the blade is coupled to the shroud and at least one hole in which the blade is coupled to the hub, there is an effect that it is easy to check and examine the coupling state of the blade, the shroud, and the hub.

Meanwhile, the method of manufacturing an impeller according to an embodiment of the present disclosure has an effect of minimizing deformation of a product due to assembly by performing a heat treatment process for the temporarily coupled shroud, blade and hub.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An impeller, comprising:

a hub in which a plurality of spiral first slots is formed;

a shroud, which is positioned opposite the hub and has a plurality of spiral second slots formed therein; and a plurality of blades, which is coupled to the hub and the shroud, each blade including a body, an upper edge, and a lower edge, at least one upper protrusion formed on a first side of each blade of the plurality of blades at the upper edge, and at least one lower protrusion formed on a second side of each blade of the plurality of blades at the lower edge, wherein the upper edge of each blade is curved with respect to the body and the lower edge of each blade is curved with respect to the body such that the upper edge and the lower edge are spaced apart in a circumferential direction but extend parallel to one another in an axial direction, wherein the upper protrusions of the plurality of blades are each inserted into and coupled, respectively, to a second hole formed in the plurality of second slots, and the lower protrusions of the plurality of blades are each inserted into and coupled, respectively, to a first hole formed in the plurality of first slots, and wherein a sum of a height of the upper protrusions and a depth of the plurality of second slots is greater than or equal to a thickness of the shroud, and a sum of a height of the lower protrusions and a depth of the plurality of first slots is greater than or equal to a thickness of the hub.

2. The impeller of claim 1, wherein the shroud, the hub, and the plurality of blades are formed of an aluminum alloy.

3. The impeller of claim 2, wherein a strength of the shroud is higher than a strength of the plurality of blades and the hub.

4. The impeller of claim 1, wherein the upper protrusions and the lower protrusions are spaced apart from a front edge (FE) and a rear edge (RE) of the plurality of blades by at least a certain distance.

5. The impeller of claim 1, wherein the shroud comprises a plurality of ribs circularly spaced apart from each other on an upper surface thereof.

6. The impeller of claim 5, wherein the plurality of ribs is formed to have a thicker thickness as the plurality of ribs is located closer to a suction port of the shroud.

7. The impeller of claim 1, wherein the impeller further comprises a coupling member which is injected between the respective upper protrusion and second hole and between the respective lower protrusion and first hole.

8. The impeller of claim 7, wherein the coupling member is a welding coupling and achieved in a welding manner.

9. The impeller of claim 1, wherein the plurality of blades is formed by sheet metal processing, and the shroud and the hub are formed by a numerical control (NC) processing.

10. An impeller, comprising:

a hub in which a plurality of first slots is formed;

a shroud, which is positioned opposite the hub and has a plurality of second slots formed therein; and a plurality of blades, which is coupled to the hub and the shroud, each blade including a body, an upper edge, and a lower edge, at least one upper protrusion formed on a first side of each blade of the plurality of blades at the upper edge, and at least one lower protrusion formed on a second side of each blade of the plurality of blades at the lower edge, wherein the upper edge of each blade is curved with respect to the body and the lower edge of each blade is curved with respect to the body such that the upper edge and the lower edge are spaced apart in a circumferential direction but extend parallel to one another in an axial direction, wherein the upper protrusions of the plurality of blades are coupled, respectively, to the plurality of second slots, and the lower protrusions of the plurality of blades are coupled, respectively, to the plurality of first slots, wherein a sum of a height of the upper protrusions and a depth of the plurality of second slots is greater than or equal to a thickness of the shroud, and a sum of a height of the lower protrusions and a depth of the plurality of first slots is greater than or equal to a thickness of the hub.

11. The impeller of claim 10, wherein the plurality of first slots each comprises:

a groove into which the lower edge of the respective blade is inserted; and at least one first hole into which the respective lower protrusion of the respective blade is inserted.

12. The impeller of claim 11, wherein the groove extends in a radial direction from the hub and is rounded to one side on a plane orthogonal to a shaft direction of the hub.

13. The impeller of claim 12, wherein the at least one first hole comprises a plurality of the first holes spaced apart from each other inside of the groove.

14. The impeller of claim 10, wherein the upper protrusions and the lower protrusions are spaced apart from a front edge (FE) and a rear edge (RE) of the plurality of blades by at least a certain distance.

15. A method of manufacturing an impeller, the method comprising:

forming a hub in which a plurality of spiral first slots is formed;

forming a shroud in which a plurality of spiral second slots is formed;

forming a plurality of blades, each having a body, an upper edge, and a lower edge, at least one upper protrusion formed on a first side of a blade of the plurality of blades at the upper edge, and at least one lower protrusion formed on a second side of the blade of the plurality of blades at the lower edge, wherein the upper edge of each blade is curved with respect to the body and the lower edge of each blade is curved with respect to the body such that the upper edge and the lower edge are spaced apart in a circumferential direction but extend parallel to one another in an axial direction, and wherein a sum of a height of the upper protrusions and a depth of the plurality of second slots is greater than or equal to a thickness of the shroud, and a sum of a height of the lower protrusions and a depth of the plurality of first slots is greater than or equal to a thickness of the hub;

inserting the lower protrusions of the plurality of blades into a plurality of first holes of the hub;

inserting the upper protrusions of the plurality of blades into a plurality of second holes of the shroud; and performing welding processing at a point at which the upper protrusions and the plurality of second holes are coupled, and at a point at which the lower protrusions n and the plurality of first holes are coupled.

16. The method of claim 15, after the performing of the welding processing, further comprising performing a heat treatment process for the coupled shroud, plurality of blades, and hub.

17. The method of claim 15, wherein the forming of the plurality of blades comprises forming the plurality of blades by sheet metal processing, and the forming of the hub and the forming of the shroud comprise forming the hub and the shroud by numerical control (NC) processing.

18. The method of claim 15, wherein the inserting of the lower protrusions, the inserting of the upper protrusions, and the performing of the welding processing are performed using a provisional assembly zig.

* * * * *